US011705648B2

(12) United States Patent
Battle

(10) Patent No.: US 11,705,648 B2
(45) Date of Patent: Jul. 18, 2023

(54) REUSABLE MAINS-POWER ELECTRICAL CONNECTOR

(71) Applicant: Sicame Australia Pty Ltd, Yatala (AU)

(72) Inventor: Alexander Battle, Yatala (AU)

(73) Assignee: SICAME AUSTRALIA PTY LTD, Yatala (AU)

( * ) Notice: Subject to any disclaimer, the term of this patent is extended or adjusted under 35 U.S.C. 154(b) by 52 days.

(21) Appl. No.: 17/457,509

(22) Filed: Dec. 3, 2021

(65) Prior Publication Data

US 2022/0311155 A1 Sep. 29, 2022

(30) Foreign Application Priority Data

Feb. 24, 2021 (AU) ..... 2021101027

(51) Int. Cl.

| | |
|---|---|
| ***H01R 4/00*** | (2006.01) |
| ***H01R 4/36*** | (2006.01) |
| ***H01R 4/70*** | (2006.01) |
| ***H01R 43/04*** | (2006.01) |

(52) U.S. Cl.
CPC ..... *H01R 4/363* (2013.01); *H01R 4/70* (2013.01); *H01R 43/04* (2013.01)

(58) Field of Classification Search
CPC ..... H01R 4/363; H01R 4/70; H01R 43/04
See application file for complete search history.

(56) References Cited

U.S. PATENT DOCUMENTS

| | | | | |
|---|---|---|---|---|
| 3,940,170 A * | 2/1976 | Williams | A47G 27/0493 | 81/463 |
| 4,427,258 A * | 1/1984 | Mueller | H01R 4/36 | 439/814 |
| 4,611,876 A * | 9/1986 | Barrabes | H01R 4/301 | 439/810 |
| 4,810,212 A * | 3/1989 | Norden | H01R 4/38 | 439/810 |
| 5,007,864 A * | 4/1991 | Stutz, Jr. | A61N 1/3752 | 439/177 |
| 5,032,092 A * | 7/1991 | Linn | H01R 9/24 | 439/814 |
| 5,533,913 A * | 7/1996 | Boehm | H01R 4/36 | 439/810 |
| 6,663,443 B1 * | 12/2003 | Smith | H01R 4/36 | 439/810 |
| 7,377,795 B2 * | 5/2008 | Vicich | H05K 3/3426 | 439/83 |
| 7,384,317 B1 * | 6/2008 | Pijoan Parellada | H01H 71/08 | 439/814 |

* cited by examiner

*Primary Examiner* — Phuong Chi Thi Nguyen
(74) *Attorney, Agent, or Firm* — Hamilton, Brook, Smith & Reynolds, P.C.

(57) ABSTRACT

The present invention relates to a reusable mains-power electrical connector. The connector includes a connector body for receiving cables and fasteners. One or more protectors are located within the body to protect the received cables when the fasteners engage with the protectors to fasten the cables within the body. The connector also includes relieving means for relieving the cables of the protectors when releasing the fasteners to remove the cables. Advantageously, the connector may be re-used when the fasteners engage with the protectors to fasten new cables received within the body.

19 Claims, 2 Drawing Sheets

REUSABLE MAINS-POWER ELECTRICAL CONNECTOR

RELATED APPLICATION

This application claims priority under 35 U.S.C. § 119 or 365 to Australian Application No. 2021101027, filed on Feb. 24, 2021. The entire teachings of the above application are incorporated herein by reference.

TECHNICAL FIELD

The present invention relates to mains-power electrical connectors. The present invention has particular, although not exclusive application to mains-power electrical connectors used in underground power distribution systems.

BACKGROUND

The reference to any prior art in this specification is not, and should not be taken as an acknowledgement or any form of suggestion that the prior art forms part of the common general knowledge.

Low voltage (LV) mains-power electrical connectors are used for connecting two or more mains-power (e.g. 110V, 240V, 415V, etc.) electrical cables together. In underground power distribution systems, for example, lengths of insulated cable are serially connected together (i.e. daisy chained) using mains-power connectors which are located within protective "pillar" boxes, pits or handholes.

These connectors typically include a connector body. The connector body includes an electrically conductive core defining passages for receiving respective cables, and apertures for receiving fasteners to fasten the cables within the passages. The connector body further includes a protective insulator cover which covers the core. In use, a respective cable is located in each passage and the fasteners are engaged within the passages so as to clamp the cables therein and form an electrical connection between the cables via the core (and fasteners). The cables can be stripped of their insulation before fastening or, in some applications, the base of the fastener may include opposed piercing teeth for piercing the cable insulation.

In practice, connectors are typically single use connectors which are discarded after their life when re-wiring LV networks. The Applicant has perceived a need for a reusable mains-power electrical connector.

SUMMARY OF THE INVENTION

According to one aspect of the present invention, there is provided a reusable mains-power electrical connector including: a connector body for receiving cables and fasteners; one or more protectors for locating within the body to protect the received cables when the fasteners engage with the protectors to fasten the cables within the body; and relieving means for relieving the cables of the protectors when releasing the fasteners to remove the cables.

Advantageously, the connector may be re-used when the fasteners engage with the protectors to fasten new cables received within the body.

The relieving means may include biasing means for biasing the protectors away from the cables and toward the fasteners. The relieving means may separate the protectors from the cables. The relieving means may include a spring. The relieving means may include a retainer for retaining the biasing means in the body. The retainer may include a rod passing through the biasing means. The retainer may be received within the body.

Each protector may include a plate. Each plate may be conductive. Each plate may define a guide for guiding a fastener. The protector may include two protectors engaging with respective cables.

The body may include an electrically conductive core. The connector body may further include a protective insulator cover which covers the core. The insulator cover may be overmolded over the core.

According to another aspect of the present invention, there is provided a method for re-using a mains-power electrical connector, the connector including a connector body for receiving cables and fasteners, the connector further including one or more protectors within the body to protect the received cables when the fasteners engage with the protectors to fasten the cables within the body, the method involving: relieving means automatically relieving the cables of the protectors when releasing the fasteners to remove the cables.

Any of the features described herein can be combined in any combination with any one or more of the other features described herein within the scope of the invention.

BRIEF DESCRIPTION OF THE DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows.

DETAILED DESCRIPTION OF PREFERRED EMBODIMENTS

Figure 1:
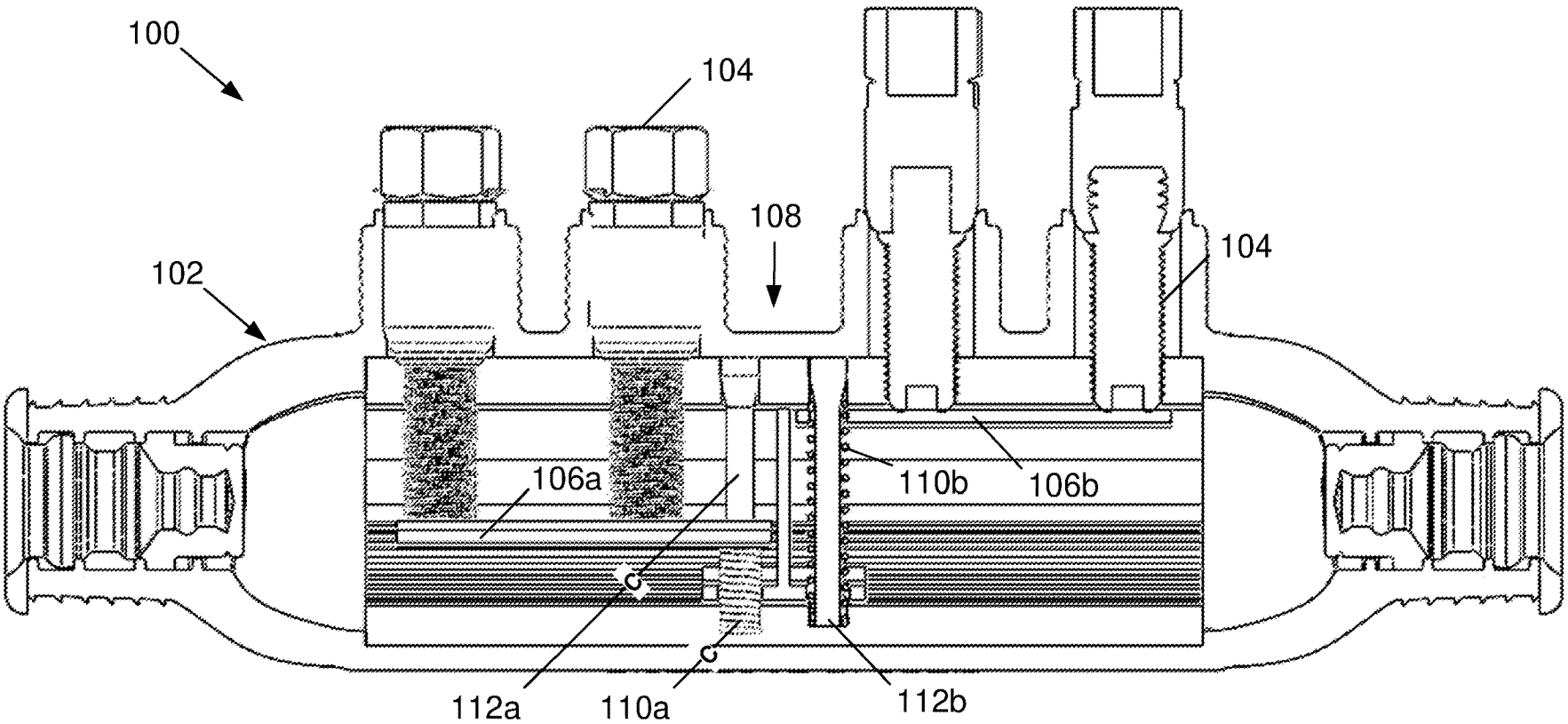
FIG. 1 is a side sectional view of a reusable mains-power electrical connector in accordance with an embodiment of the present invention.

According to an embodiment of the present invention, there is provided a reusable mains-power electrical connector 100 as shown in FIG. 1. The connector 100 includes a connector body 102 for receiving opposed cables (not shown) at either end, and transverse threaded fasteners 104.

A pair of protectors 106*a*, 106*b* are located within the body 102 to protect the received cables when the fasteners 104 engage with the protectors 106 to clamp and fasten the cables within the body 102.

The connector 100 further includes central relieving means 108 (i.e. mechanism) for relieving the cables of the protectors 106 when releasing the fasteners 104 to remove the cables.

Advantageously, the connector 100 can be re-used when the fasteners re-engage with the protectors 106 to fasten new cables received within the body 102 during re-wiring of a network.

The relieving means 108 includes biasing means 110*a*, 110*b* for respectively biasing the protectors 106*a*, 106*b* away from the cables underneath and toward the fasteners 104. The relieving means 108 separates the protectors 106 from the cables so that the new cables can be freely inserted in the body 102.

The biasing means 110*a*, 110*b* (i.e. mechanisms) are compression springs, and elongate retainers 112*a*, 112*b* retain the springs in the body 102. Each retainer 112 includes a rod passing through both the protector 106 and spring. The spring diameter is greater than the hole in the end of the protector 106 so that the protector 106 can freely slide along the retainer 112, and the spring remains on one side of the protector 106 without passing through the hole. Each retainer 112 is received and force fitted within the body 102.

Figure 2:
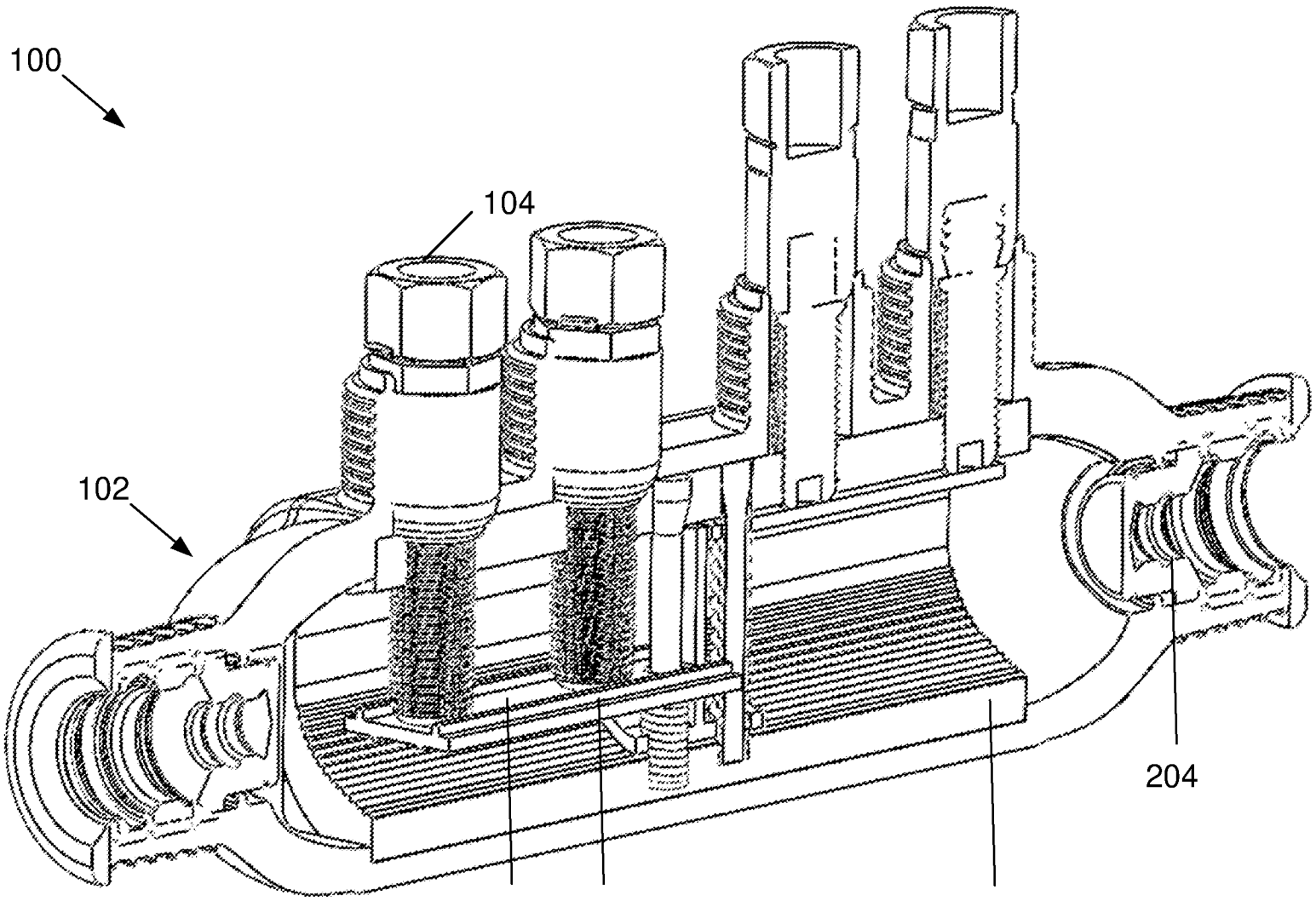
FIG. 2 is an upper perspective sectional view of the reusable mains-power electrical connector of FIG. 1.

Turning to FIG. 2, each protector 106 includes a plate that defines a pair of upper guide lips 200 for guiding the protector 106 to remain aligned with respect to the fasteners 104.

The body 102 includes an electrically conductive core 202. The connector body 102 further includes a protective insulator cover 204 which covers the core 202. The resilient insulator cover 204 is over molded over the core 202. Each bolt fastener 104 and plate 106 is also conductive.

A method for re-using the mains-power electrical connector 100 is now briefly explained.

Initially, the connector 100 is in use, with the tightened fasteners 104 engaging with the protectors 106*a*, 106*b* to fasten the cables within the body 102 as shown on the left hand side of FIGS. 1 and 2.

The user unscrews the fasteners 104 as shown on the right hand side of FIGS. 1 and 2. In turn, the relieving means 108 automatically relieves the cables of the separated protectors 106 so that the user can freely remove the cables from the body 102.

A user can tip the connector 100 upside down to ensure the protectors 106*a*, 106*b* do not obstruct entry of new cables to be connected. Once the new cables are fully inserted into the body 102, the fasteners 104 are re-tightened again to secure the new cables beneath the protectors 106.

A person skilled in the art will appreciate that many embodiments and variations can be made without departing from the ambit of the present invention.

The invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the appended claims appropriately interpreted by those skilled in the art.

Reference throughout this specification to 'one embodiment' or 'an embodiment' means that a particular feature, structure, or characteristic described in connection with the embodiment is included in at least one embodiment of the present invention. Thus, the appearance of the phrases 'in one embodiment' or 'in an embodiment' in various places throughout this specification are not necessarily all referring to the same embodiment. Furthermore, the particular features, structures, or characteristics may be combined in any suitable manner in one or more combinations.

What is claimed is:

1. A reusable mains-power electrical connector including: a connector body receiving cables and fasteners; one or more protectors locating within the body to protect the received cables when the fasteners engage with the protectors to fasten the cables within the body; and a relieving mechanism relieving the cables of the protectors when releasing the fasteners to remove the cables, wherein the relieving mechanism includes a spring.

2. The connector as claimed in claim 1, configured to be re-used when the fasteners engage with the protectors to fasten new cables received within the body.

3. The connector as claimed in claim 1, wherein the relieving mechanism includes a biasing mechanism for biasing the protectors away from the cables and toward the fasteners.

4. The connector as claimed in claim 1, wherein the relieving mechanism separates the protectors from the cables.

5. The connector as claimed in claim 1, wherein the protectors include two protectors engaging with respective cables.

6. The connector as claimed in claim 1, wherein the relieving mechanism includes a retainer for retaining the biasing mechanism in the body.

7. The connector as claimed in claim 6, wherein the retainer includes a rod passing through the biasing mechanism.

8. The connector as claimed in claim 6, wherein the retainer is received within the body.

9. The connector as claimed in claim 1, wherein each protector includes a plate.

10. The connector as claimed in claim 9, wherein each plate is conductive.

11. The connector as claimed in claim 9, wherein each plate defines a guide for guiding a fastener.

12. The connector as claimed in claim 1, wherein the body includes an electrically conductive core.

13. The connector as claimed in claim 12, wherein the connector body further includes a protective insulator cover which covers the core.

14. The connector as claimed in claim 13, wherein the insulator cover is overmolded over the core.

15. A method of re-using a mains-power electrical connector, the connector including a connector body receiving cables and fasteners, the connector further including one or more protectors within the body to protect the received cables when the fasteners engage with the protectors to fasten the cables within the body, the method involving:

a relieving mechanism automatically relieving the cables of the protectors when releasing the fasteners to remove the cables, wherein the relieving mechanism includes a spring.

16. The method as claimed in claim 15, further involving re-using the connector when the fasteners engage with the protectors to fasten new cables received within the body.

17. The method as claimed in claim 15, further involving biasing the protectors away from the cables and toward the fasteners.

18. The method as claimed in claim 15, further involving separating the protectors from the cables.

19. The method as claimed in claim 15, further involving retaining a biasing mechanism in the body; and overmolding an insulator over a core of the body.

* * * * *